United States Patent [19]

Gutiérrez

[11] Patent Number: 4,811,948

[45] Date of Patent: Mar. 14, 1989

[54] CUBE AND PEGS ASSEMBLY PUZZLE

[76] Inventor: J. Guadalupe Gutiérrez, Veracruz 516, Aguascalientes, Ags 20070, Mexico

[21] Appl. No.: 161,744

[22] Filed: Feb. 29, 1988

[51] Int. Cl.[4] ..... A63F 9/12

[52] U.S. Cl. ..... 273/156; 273/160

[58] Field of Search ..... 273/156, 157 R, 160

[56] References Cited

U.S. PATENT DOCUMENTS

| | | | |
|---|---|---|---|
| 472,292 | 4/1892 | Goodson . | |
| 3,114,548 | 12/1963 | Taft . | |
| 3,165,750 | 1/1965 | Tell . | |
| 3,375,009 | 3/1968 | Stubbmann | 273/156 |
| 3,612,537 | 10/1971 | Sato | 273/156 |
| 3,813,099 | 5/1974 | Scott | 273/156 |
| 4,154,444 | 5/1979 | Grenell | 273/273 |
| 4,206,923 | 6/1980 | Cloutier | 273/160 |
| 4,283,055 | 8/1981 | Larsen | 273/160 |
| 4,548,411 | 10/1985 | Seidman | 273/153 R |

*Primary Examiner*—Anton O. Oechsle

[57] ABSTRACT

A puzzle game comprising a hexahedral semisold body (10) having a number of non through-holes (12) and a like number of round pegs (18) to be plugged into the said holes. The holes of the hexahedral body are made on three faces (11) sharing the same vertex (14). Each hole on any face intersects sideways sets of aligned holes of each of the remaining two perforated faces. The pegs are provided with pairs of round notches (20). When a peg is plugged into a hole, the holes in intersection with the peg in question are either unaffected or obstructed by the peg inserted depending on the matching or mismatching respectively with the shaves of the holes. The matching-mismatching condition can be controlled by peg twisting. Besides the notches, the pegs are provided in some parts with smaller square cross sections and/or smaller round cross sections. These latter mechanisms can allow a peg meeting another, inside the body portion, either to let the second peg rotate freely or to hinder it from any rotation. As more and more pegs are inserted into the holes, the three-dimensional chain interaction builds up to unexpected levels. The insertion of all the pegs is the object of the puzzle.

4 Claims, 2 Drawing Sheets

CUBE AND PEGS ASSEMBLY PUZZLE

BACKGROUND

1. Field of Invention

This invention relates to the three-dimensional puzzle toys which aim is getting all the pieces assembled together. In the present case, the player has to insert a number of pegs into a perforated cube.

2. Description of Prior Art

There are several toys of this kind. The one with the registered trademark of Rubik's Cube may be the most famous. The hollow sphere with openings for pins in U.S. Pat. No. 3,813,099 to Scott, May 28, 1974 and the hollow hexahedron with openings for rods in U.S. Pat. No. 3,612,537 to Sato, Oct. 12, 1971 may be the closest conceptions to the present idea.

OBJECTS AND ADVANTAGES

The present invention includes a cube and 27 pegs. In the cube, a set of nine holes have been made on each one of three of its faces. These three faces having a common vertex. The arrangement of holes of any one face is made in such a way that when they come across the set of holes of either one of the remaining two faces, they pass through each other but their centers do not fit. The 27 pegs are made for the purpose of plugging them into an equal number of holes in the cubes. A special arrangement of notches has been made to each peg so that three pegs, in a perpendicular relation to each other, can share a common intersection inside the cube. Thus the ultimate goal is to get the 27 pegs into the cube, although in some cases it will be necessary to rotate 180° one peg that is already inside to let the next one be pushed in.

An object of the invention is to pose a challenge for the smart, inquisitive minds by providing a puzzle with simple geometrical shapes neatly arranged. Another object is to stimulate the mind of the player for a three-dimensional thinking while having fun.

One advantage is that although the cost of production can be low, this puzzle offers a great appeal like in usually expensive ones, especially if it is made of transparent material. This is because of the plurality of perforations and spatial intersections inside the cube, and looks even a lot better if the pegs are colored but are kept transparent. Another advantage is that the excitement of the game builds up as more and more pegs are being plugged in since they interact with each other in a way that sometimes a peg can not be pushed in, or rotated, or pulled out, unless another peg or pegs are either rotated or pulled out. After all of "hardships", the satisfaction of getting the 27 pegs into the cube is the best reward for the player.

Other objects, features and advantages will be made apparent with the "description of the invention" supported by drawings.

DESCRIPTION OF DRAWINGS

The invention now will be explained with the aid of drawings in which.

DRAWING REFERENCE NUMERALS

10 cubic body portion
11 faces of 10 that share common vertex 14
12 holes of 10
14 common vertex of faces 11
16 grooves of 10
18 pegs
20 notches of 18
22 carving of 18

DESCRIPTION OF THE INVENTION

Figure 1:
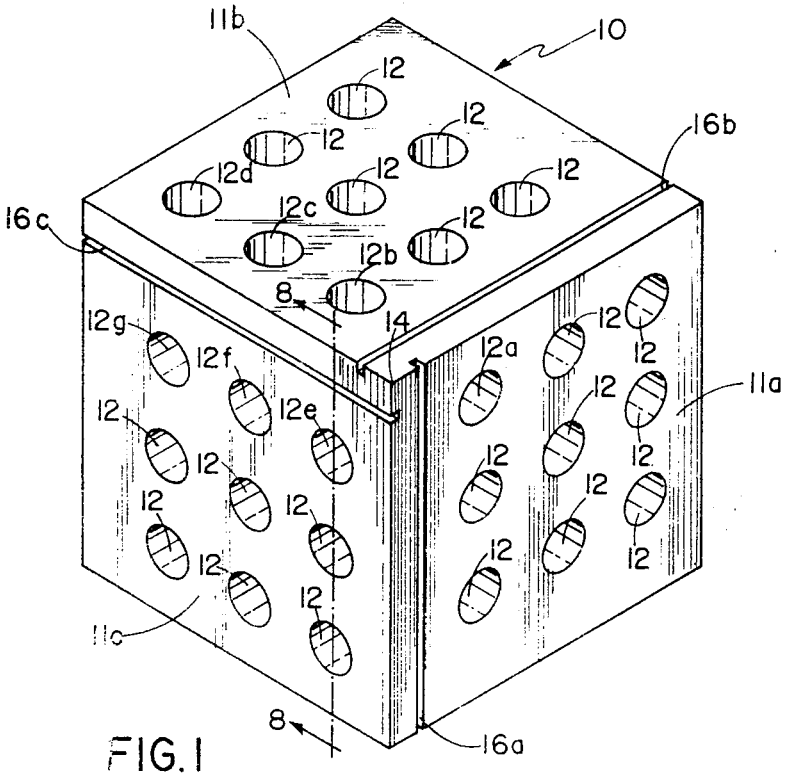
FIG. 1 is a perspective view of the cubic body portion of the puzzle toy showing the three and only perforated faces.
Figure 2:
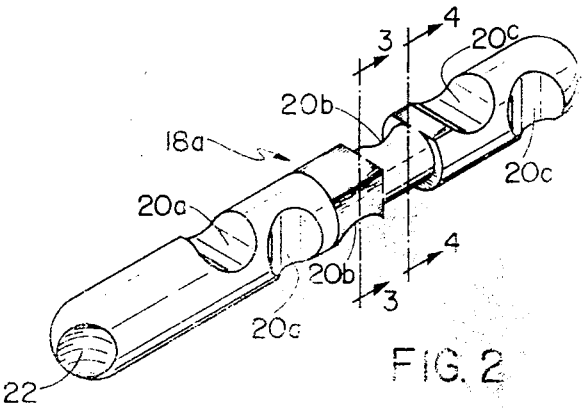
FIG. 2 shows a perspective view of one peg of a group of 24 to be inserted into the body portion shown in FIG. 1.
Figure 4:
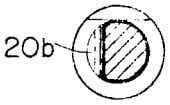
FIG. 4 is a cross-sectional view taken along line 4—4 in FIG. 2.

The toy of the present invention is comprised by a semi-solid cubic body portion 10 generally shown in FIG. 1 and two sets of round pegs indicated in FIG. 2 and FIG. 4. The cube 10 is provided with sets of 9 non-through round holes 12 in perfect square array on only three of its faces 11 having a common vertex 14. The "square" of holes 12 on any one face 11 does not have the same geometrical center as the said face 11. In a frontal view of any of the three perforated faces 11, and having the common vertex 14 at the upper left, the geometrical center of the square array of 9 holes 12 is moved a little to the right and above the geometrical center of the said face 11 of the body portion 10. This happens with exactly the same dimensions on the three perforated faces 11. This mismatching can be done too having the geometrical center of the "square" of holes 12 moved to the left and under the geometrical center of the said face 11 of the body portion 10. I arbitrarily chose the first option for this disclosure. This mismatching of centers on each of the three faces 11 is done so any hole 12 of any one face 11 intersects sideways with a set of three aligned holes 12 per each one of the remaining two faces 11.

Figure 5:
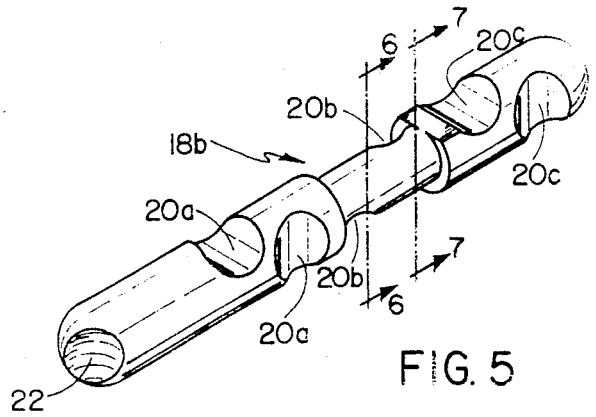
FIG. 5 shows a perspective view of one peg of a group of three to be inserted into the body portion shown in FIG. 1.

The sets of pegs 18 like those shown in FIG. 2 and FIG. 5 are adapted to be inserted into the holes 12. The pegs 18 have a diameter that easily fits into any of the holes 12 with enough freedom to be twisted once the peg 18 is inside. The pegs 18 are composed of a set of pegs **18*a* shown in FIG. 2 and a set of pegs 18*b* shown in FIG. 5. They are classified in respect to a different cross section at about half way of the length of the peg as shown in FIG. 2 for a set of 24 pegs 18*a* and FIG. 5 for the set of three pegs 18*b*. The total number of the pegs 18 from the sets 18*a* and 18*b* is 27 which is the same as the total number of holes 12 in the body portion 10**.

Three pairs of two notches 20 are carved along each peg 18. The distance from the first pair of notches **20*a* to the second pair of notches 20*b* is the same as the distance from the said pair 20*b* to the pair 20*c* (FIG. 2 and FIG. 5). The pairs of notches 20*a* and 20*c* are pointing to the same direction, but the pair 20*b*, located in the middle portion of the peg 18, is 180° turned in the opposite direction. The said notches 20 are made for the purpose of allowing insertion to two or three pegs 18 into intersecting holes 12 provided that the said notches 20 match the shaves of the holes in question. The carving or pointing means 22 at the very tip of the pegs 18 serves for the only purpose of orientation when the peg 18 is all the way inside the body portion 10 and the tip with the carving 22 is the only protruding part. Since there is a groove 16 or any kind of similar mark on every face 11, the carving 22 should either face the said groove 16 or oppose it completely. If there is one peg 18 inserted in any hole 12 of any face 11 and the carving 22 is pointing to the groove 16 of the same face, there will be three holes 12 in intersection with the peg in question per each of the other two faces 11 but only two holes of the three will receive another peg 18. For example, if the player inserts the first peg 18 in the hole 12*a* with the carving 22 pointing to the groove 16*a*, then he will be able to continue pushing two more pegs into holes 12*b* and 12*d* respectively and two more pegs later into holes 12*e* and 12*g* (provided that pegs inserted in holes 12*b* and 12*d* have the carvings 22 pointing to the groove 16*b*), but holes 12*c* and 12*f*** will be blocked.

On the other hand, if the player chooses to insert the first peg 18 in the same hole **12*a* but with the carving 22 opposing the groove 16*a*, then he will be able to continue pushing one more peg into hole 12*c* and another later into hole 12*f* (provided that peg inserted in hole 12*c* has the carving 22 pointing to the groove 16*b*), but holes 12*b*, 12*d*, 12*e* and 12*g* will be blocked. If in this moment the player twists 180° the peg inside hole 12*a*, then he will be able to push two more pegs into holes 12*b* and 12*d*, and two more into holes 12*e* and 12*g* (provided that the pegs 18 inserted in holes 12*b* and 12*d* have the respective carvings 22 pointing to the groove 16*b***).

As it can be seen, every intersection inside the body portion 10 sums up to three pegs 18 involved. All the pegs interact each other in different ways depending on the kind of notches 20 involved (**20*a*, 20*b*, or 20*c*). There are 27 three-peg intersections inside the body portion 10** classified as follows:

| Kind of Intersection | Number of Intersections |
|---|---|
| Pairs of Notches 20a/20a/20a | 1 |
| Pairs of Notches 20a/20a/20b | 3 |
| Pairs of Notches 20a/20a/20c | 3 |
| Pairs of Notches 20a/20b/20b | 3 |
| Pairs of Notches 20a/20b/20c | 6 |
| Pairs of Notches 20a/20c/20c | 3 |
| Pairs of Notches 20b/20b/20b | 1 |
| Pairs of Notches 20b/20b/20c | 3 |
| Pairs of Notches 20b/20c/20c | 3 |
| Pairs of Notches 20c/20c/20c | 1 |
| Total | 27 |

Figure 3:
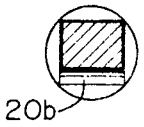
FIG. 3 is a cross-sectional view taken along line 3—3 in FIG. 2.
Figure 6:
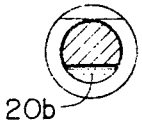
FIG. 6 is a cross-sectional view taken along line 6—6 in FIG. 5.
Figure 7:
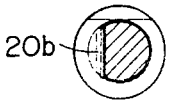
FIG. 7 is a cross-sectional view taken along line 7—7 in FIG. 5.
Figure 8:
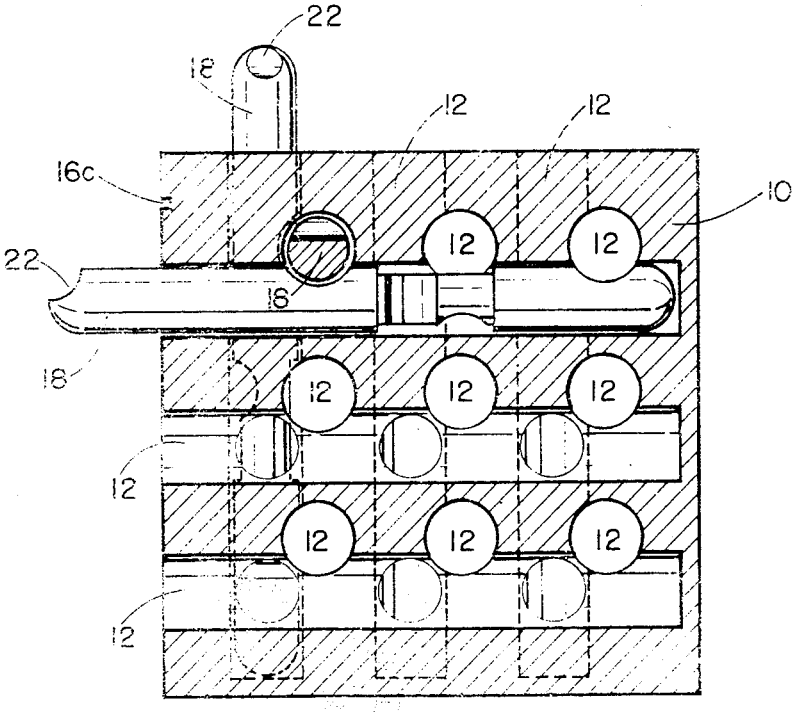
FIG. 8 is a cross section view taken substantially along line 8—8 in FIG. 1.

More than just notches is involved in each peg 18. In the set of 24 pegs **18*a* (FIG. 2), the diameter of the cross section of the peg is smaller along the pair of notches 20*b*, but is square along one notch and round for the other (see FIG. 2, FIG. 3 and FIG. 4). In the set of three pegs 18*b* (FIG. 5), the reduced cross section is round along the two notches 20*b* (see FIG. 5, FIG. 6 and FIG. 7). These reduced cross sections play a role only when two pegs 18 meet one another intersecting both in the said reduced cross sections (that is in the portion of pairs of notches 20*b*). If such an intersection happens, we can have a round reduced cross section meeting a square reduced cross section or a round one meeting another round. When a round section (see FIG. 4, FIG. 6 and FIG. 7) of a peg 18 meets a square section (see FIG. 3) of another peg 18**, only the peg touching with the round section can be twisted. But when a round section of a peg meets another round section of another peg, then any of the two pegs can be twisted.

Both the notches 20 and the reduced cross sections work to produce a chain of interferences preventing the player either from plugging new pegs in or from twisting those already inside. But provided that the player likes challenge and is persistent, the puzzle will eventually be solved, in other words, all the pegs will be plugged in. Deep thinking is spurred in the player's mind when engaged in the attempt of solving the puzzle and a great satisfaction is the best reward when he finally gets to the solution.

Although in the considered embodiment the body portion 10 has a cubic shape, this can even be changed to a sphere or other shapes however keeping the same function principle. Variants can be done changing the number of holes 12 on some faces 11 or on all of them.

I claim:

1. A puzzle game comprising:

a body portion having two or three sets of holes, the said sets of holes disposed perpendicularly respect to each other, said sets of holes intersecting sideways each other, and a number of pegs made for the purpose of being inserted into the said holes, the said pegs having notches to allow insertion of two or three of the said pegs into the said body portion without blocking each other's way even when sharing a common intersection, each of the said pegs being rotatory inside the said body portion so insertion of new said pegs will be blocked if said notches do not match said common intersection, the said pegs having a round cross section, each of the said pegs having three pairs of said notches along itself, the arrangement of notches respect to each other in any one of the said pairs is such that going from any end of the peg to the other, the second notch met in any of the three pairs of notches is rotated 90 degrees in the peg's longitudinal axis respect to the first notch met, the said 90 degree rotation being either clockwise or counter-clockwise for all the said pegs, but never both, the two respective notches in each of the extremes of the said pegs facing in same direction and the notches in the middle pair respectively facing in two directions which are opposite to the directions in which the notch pairs at the extreme of the pegs face, the said pegs having a smaller cross section along the middle pair of notches, all the said smaller cross sections being round for a group of said pegs, half of the smaller cross section being round and the other half being square for another group of said pegs, the said smaller cross sections being provided as means to allow rotation of either one or two pegs when these two pegs meet each other, inside the said body portion, at their respective smaller cross sections.

2. The puzzle game claimed in claim 1, characterized by a cubic shape of the said body portion having three of the said sets of holes, the said holes being non-through holes, having a round cross section, being nine per said set and keeping a perfect square arrangement.

3. The puzzle game claimed in claim 1, wherein the said group of pegs with all the said smaller cross section being round, is composed of three pegs, and the other said group of pegs having one half of their smaller cross section round, and the other half square, is composed of 24 pegs.

4. The puzzle game claimed in claim 3, characterized by the said pegs having a protruding section once they are inserted into the said body portion, said protruding section having a carving or pointing means to either face or oppose a position mark on the respective face on the said body portion.

* * * * *